US006225014B1

(12) United States Patent
Patterson et al.

(10) Patent No.: US 6,225,014 B1
(45) Date of Patent: May 1, 2001

(54) PHOTORECEPTOR WITH VINYL ACETATE LAYER

(75) Inventors: Neil S. Patterson, Pittsford; Joseph S. Cappiello, Rochester; Karen S. Garland, Palmyra; Joellen Simone, Ontario; Vincent J. Cilento, Rochester; June E. Schneider, Honeoye Falls; John A. Bergfiord, Sr., Macedon, all of NY (US); Michelle Acevedo Lazor, Alexandria, VA (US); Satchidanand Mishra, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/479,045

(22) Filed: Jan. 7, 2000

(51) Int. Cl.[7] ..... G03G 5/14
(52) U.S. Cl. ..... 430/64; 430/60
(58) Field of Search ..... 430/60, 62, 64

(56) References Cited

U.S. PATENT DOCUMENTS

| | | | | |
|---|---|---|---|---|
| 4,229,510 | * | 10/1980 | Watarai et al. | 430/38 |
| 4,786,570 | | 11/1988 | Yu et al. | 430/58 |
| 5,008,169 | | 4/1991 | Yu et al. | 430/59 |
| 5,378,566 | | 1/1995 | Yu | 430/58 |

* cited by examiner

*Primary Examiner*—John Goodrow
(74) *Attorney, Agent, or Firm*—Zosan S. Soong

(57) ABSTRACT

An electrostatographic imaging member including: (a) a substrate; (b) a layer including a vinyl acetate composition; and (c) an imaging layer.

25 Claims, 2 Drawing Sheets

PHOTORECEPTOR WITH VINYL ACETATE LAYER

FIELD OF THE INVENTION

This invention relates in general to electrostatography and more specifically to photoreceptors.

BACKGROUND OF THE INVENTION

Yu, U.S. Pat. No. 5,378,566 ("Yu Patent") discloses in the abstract an electrophotographic imaging member including a substrate, a hole blocking adhesive layer, a charge generating layer and a charge transport layer, the hole blocking adhesive layer including a polyester film forming binder having dispersed therein a particulate reaction product of metal oxide particles and a hydrolyzed reactant selected from the group consisting of a nitrogen containing organo silane, an organotitanate, and an organozirconate and mixtures thereof. In the abstract of the Yu Patent, it is stated that the electrophotographic imaging member is preferably free of any distinct adhesive layer in contiguous contact with the hole blocking adhesive layer.

While the electrophotographic imaging members disclosed in the Yu Patent are suitable for their intended purpose, there continues to be a need, which the present invention addresses, for new hole blocking adhesive layers and new adhesive layers that exhibit good adhesive properties using environmentally friendly materials.

Conventional electrophotographic imaging members are also disclosed in Yu et al., U.S. Pat. No. 5,008,169 and Yu et al., U.S. Pat. No. 4,786,570.

SUMMARY OF THE INVENTION

The present invention is accomplished in embodiments by providing an electrostatographic imaging member comprising:

(a) a substrate;

(b) a layer including a vinyl acetate composition; and (c) an imaging layer.

BRIEF DESCRIPTION OF THE DRAWING

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
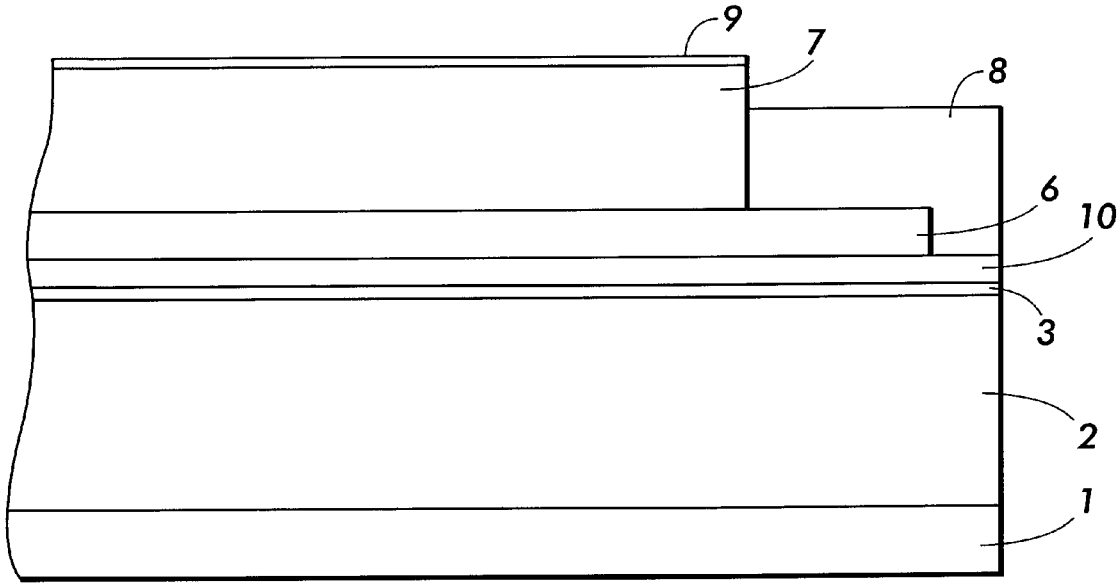
FIG. 1 shows a simplified, elevational view of one embodiment of the present invention.

The supporting substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate may be rigid or flexible and may have any number of different configurations such as, for example, a cylinder, a sheet, a scroll, an endless flexible belt, and the like. Preferably, the substrate is in the form of an endless flexible belt and comprises a commercially available biaxially oriented polyester known as MYLAR™, available from E. I. du Pont de Nemours & Co., or MELINEX™, available from ICI Americas Inc.

The thickness of the substrate depends on numerous factors, including mechanical performance and economic considerations. The thickness of the substrate may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device.

As indicated above, the entire substrate may be made up of electrically conductive material or may comprise multiple layers in which an outer layer comprises an electrically conductive material. The electrically conductive material may comprise an electrically conductive metal layer which may be formed, for example, on an underlying layer by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotographic imaging member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as, for example, copper iodide and conductive indium tin oxide, as a transparent layer for light having a wavelength between about 4000 Angstroms and about 9000 Angstroms or a conductive carbon black dispersed in a plastic binder as an opaque conductive layer.

For convenience, the layer including the vinyl acetate composition is referred to herein as the "vinyl acetate layer." In embodiments such as the photoreceptor configuration of FIG. 1, the vinyl acetate layer may provide both charge blocking and adhesive properties. In other embodiments such as the photoreceptor configuration of FIG. 2, the vinyl acetate layer is desired primarily for its adhesive property.

The present vinyl acetate layer may be described herein in the preferred embodiment of a hole blocking adhesive layer. However, in embodiments of the invention, the present vinyl acetate layer can be an electron blocking adhesive layer using the materials and imaging member configurations described herein.

The vinyl acetate layer comprises a polyester film forming binder (a vinyl acetate composition which is also referred herein as "polyester") having dispersed therein in certain embodiments a charge blocking material of for example a particulate reaction product of inorganic oxide particles (e.g., silica and metal oxide particles) and a hydrolyzed reactant selected from the group consisting of a nitrogen containing organosilane, an organotitanate and an organozirconate and mixtures. The particulate reaction product of silica (silicon dioxide) particles and a hydrolyzed reactant preferably comprises synthetic amorphous fumed silicas (e.g., AEROSIL™, available from Degussa AG or CAB-O-SIL™, available from Cabot, Inc.) that have been surface treated with an amino organosilane coupling agent prior to incorporation into the vinyl acetate layer of this invention. However, finely divided metal oxide particles may be substituted for silica. Typical finely divided metal oxide particles include, for example, aluminum oxide, zirconium oxide, titanium dioxide, and the like. Generally, satisfactory results may be achieved with an average inorganic particle size of between about 50 and about 300 Angstroms. These particles preferably have a generally spherical shape. However, they may have any other suitable shape such as granular, irregular and the like. The inorganic particles usually have a density between about 1.8 and about 2.6 gms/cc. The maximum particle size selected is preferably less than the thickness of the dried vinyl acetate layer.

A loading of between about 10 and about 95 weight percent by weight particulate inorganic reaction product based on the total weight of the vinyl acetate layer is satisfactory. A loading of between about 20 to about 90 weight percent by weight is preferred. Optimum ease of layer application is achieved with a loading of between about 50 and about 85 weight percent particulate inorganic reaction product. With the vinyl acetate layer of this invention, the need for the separate adhesive layer usually employed in prior art electrophotographic imaging members is eliminated in certain embodiments.

The following embodiments are encompassed by the present invention. The vinyl acetate layer may be composed entirely of the vinyl acetate composition. The vinyl acetate layer includes a vinyl acetate composition and a charge blocking material such as an organosilane, an organotitanate or an organozirconate described herein. The charge blocking material may be for example an organosilane or inorganic particles coated with an organosilane. In the vinyl acetate layer, the vinyl acetate composition and the charge blocking material may be present in a ratio by weight ranging for example from about 1 (vinyl acetate composition):1 (charge blocking material) to about 1 (vinyl acetate composition):5 (charge blocking material).

Organosilanes which having charge blocking properties are hydrolyzed and reacted with the synthetic amorphous fumed silicas or other suitable metal oxides. Typical organosilanes include, for example, 3-aminopropyltriethoxysilane, (N,N'-dimethyl 3-amino) propyl triethoxysilane, N,N-dimethylaminophenyltriethoxy silane, N-phenylaminopropyltrimethoxy silane, trimethoxysilylpropyl-diethylene triamine, N-aminoethyl-3-aminopropyl-trimethoxysilane, N-(2-aminoethyl)-3-aminopropyl-trimethoxysilane, N-2-aminoethyl-3-aminopropyl-trimethoxysilane, N-2-aminoethyl-3-aminopropyltris (ethyl-ethoxy)silane, p-aminophenyltrimethoxysilane, 3-aminopropyldiethylmethylsilane, 3-aminopropyltrimethoxysilane, N-methylaminopropyltriethoxysilane, methyl(2-(3-trimethoxysilypropylamino)ethylamino)-3-proprionate, (N,N'-dimethyl-3-amino) propyltriethoxysilane, and 3-(2-(vinylbenzylamino)ethylamino)propyltrimethoxysilane. Alternatively, organotitanates or organozirconates may be substituted for the organosilanes for inorganic particle surface treatment. Typical organotitanates include, for example, neoalkoxy tri(dioctylphosphato titanate), neoalkoxy tri (N-ethylaminoethylamino)titanate, neoalkoxy tri(m-amino) phenyltitanate, isopropyl di(4-aminobenzoyl) isostearoyl titanate and the like. Typical organozirconates include, for example, neoalkoxy trisneodecanoyl zirconate, neoalkoxy tris(dioctyl)phosphato zirconate, neoalkoxy tris(dioctyl) pyrphosphata zirconate, neoalkoxy tris(ethylene diamino) ethyl zirconate, neoalkoxy tris(m-amino)phenyl zirconate and the like.

These organosilane, organotitanate and organozirconate bi-functional chemical coupling agents are usually applied to the inorganic particles prior to dispersion of the particles into the film forming polyester resin. Any suitable technique may be utilized to apply and react the coupling agent with the surface of the inorganic particles. The deposited coupling agent coating on the particles are continuous, thin, and preferably in the form of a monolayer. A preferred process for applying these bi-functional chemical coupling agents to the inorganic particles is by stirring the inorganic particles in an aqueous solution of a hydrolyzed silane. After thoroughly wetting the surface of the inorganic particles with the aqueous solution to ensure reaction between the reactive groups on the coupling agent molecule and the hydroxyl groups on the outer surface of the inorganic particles, the treated inorganic particles may be separated from the aqueous solution by any suitable technique such as filtering. The treated inorganic particles may thereafter be dried by conventional means such as oven drying, forced air drying, combinations of vacuum and heat drying, and the like. Other techniques of silylation such as contacting the outer surface of the inorganic particles with vapors or sprays of the bi-functional coupling agent may also be employed. For example, sylylation may be accomplished by pouring or spraying the bi-functional chemical coupling onto the inorganic particles while the inorganic particles are agitated in a high intensity mixer at an elevated temperature. In this blending technique, the coupling agent is reacted with the hydroxyl groups directly attached to the metal atoms or silicon atoms at the surface of the inorganic particles to form a reaction product in which the inorganic particles and the bi-functional coupling agent are chemically bonded to each other through an oxygen atom. Such a process is described, for example, for silica in U.S. Pat. No. 3,915,735, the disclosure of which is incorporated herein by reference in its entirety.

Generally, the concentration of the bi-functional coupling agent in the treating solution should be sufficient to provide at least a continuous mono molecular layer of coupling agent on the surface of the inorganic particles. Satisfactory results may be obtained with an aqueous solution containing from about 1 percent by weight to about 5 percent by weight of coupling agent based on the weight of the solution. After drying, the inorganic particles coated with the reaction product of the bi-functional coupling agent and hydroxyl groups attached to the metal atoms or silicon atoms on the outer surface of the inorganic particles are dispersed in the film forming binder where further reaction occurs between the reactive organo functional groups of the bi-functional coupling agent and reactive groups on the film forming binder molecules to provide mechanical reinforcement. Dispersion may be effected by any suitable conventional mixing technique such as blending the treated inorganic particles with a molten thermoplastic polyester resin or in a solution of the polyester resin in a solvent. However, dispersion of the treated inorganic particles in a solution of the polyester is particularly preferred.

Aminosilane bi-functional chemical coupling agents are preferred because the amine functionality not only possess hole blocking capabilities, but also form an excellent chemical bond through interaction with COOH and OH groups of film forming polyesters and excellent chemical bonding is also achieved between the silanol groups of the silane and the hydroxyl groups of the surface of a inorganic particle through the formation of metal—oxygen—silicon bonds to the inorganic particles. These silanes are applied in hydrolyzed form because the silanol groups of the silane will readily condense with the hydroxyl groups on the inorganic particle surfaces and position the organofunctional amine group of the silane outwardly from the inorganic particle toward the film forming polyester matrix.

The hydrolyzed silane may be prepared by hydrolyzing an aminosilane having the following structural formula:

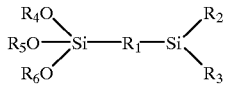

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and $R_4$, $R_5$, and $R_6$ are independently selected from a lower alkyl group containing 1 to 4 carbon atoms. Typical hydrolyzable aminosilanes include 3-aminopropyltriethoxysilane, N-aminoethyl-3aminopropyltrimethoxysilane, N-2-aminoethyl-3-aminopropyltrimethoxysilane, N-2-aminoethyl-3aminopropyltrimethoxysilane, N-2-aminoethyl-3-aminopropyltris(ethylethoxy)silane, p-aminophenyltrimethoxysilane, 3-aminopropyldiethylmethylsilane, (N,N'-dimethyl-3-amino)propyltriethoxysilane, 3-aminopropylmethyldiethoxysilane, 3-aminopropyl trimethoxysilane, N-methylaminopropyltriethoxysilane, methyl(2-(3-trimethoxysilylpropylamino)ethylamino]-3-proprionate, (N,N'-dimethyl 3-amino) propyltriethoxysilane, N,N-dimethylaminophenyltriethoxysilane, trimethoxysilylpropyldiethylenetriamine and mixtures thereof. The preferred silane materials are 3-aminopropyltriethoxysilane, N-aminoethyl-3-aminopropyltrimethoxysilane, (N,N'-dimethyl 3-amino)propyltriethoxysilane, or mixtures thereof because the hydrolyzed solutions of these materials exhibit a greater degree of basicity and stability and because these materials are readily available commercially. These silanes and others as well as the techniques for hydrolyzing are described, for example, in U.S. Pat. No. 4,464,450, the disclosure thereof being incorporated herein in its entirety. After drying, the reaction product layer formed from the hydrolyzed silane contains larger molecules. The reaction product of the hydrolyzed silane may be linear, partially cross-linked, a dimer, a trimer, and the like.

The hydrolyzed silane solution utilized to treat the inorganic particles may be prepared by adding sufficient water to hydrolyze the alkoxy groups attached to the silicon atom of the silane to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 10 percent by weight of the silane based on the total weight of solution. A solution containing from about 0.1 percent by weight to about 2.5 percent by weight silane based on the total weight of solution are preferred for stable solutions which form a uniform reaction product layer on the inorganic particles.

A solution pH between about 4 and about 14 may be employed. Optimum reaction product layers on the inorganic particles are achieved with hydrolyzed silane solutions having a pH between about 9 and about 13. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

If desired, the aqueous solution of hydrolyzed silane may also contain additives such as polar solvents other than water to promote the silylation process of involving the inorganic particles. Any suitable polar solvent other than water may be employed. Typical polar solvents include methanol, ethanol, isopropanol, tetrahydrofuran, methoxyethanol, ethoxyethanol, ethylacetate, ethylformate and mixtures thereof.

Any suitable technique may be utilized to treat the inorganic particles with the hydrolyzed silane. For example, washed inorganic particles can be swirled in a hydrolyed silane solution for between about 1 minute and about 60 minutes and then the solids thereafter allowed to settle out and remain in contact with the hydrolyzed silane for between about 1 minute and about 60 minutes. The supernatant liquid may then be decanted and the treated inorganic particles filtered with filter paper. The inorganic particles may be dried at between about 1 minute and about 60 minutes at between about 80 and about 165 degrees C in a forced air oven for between about 1 minute, and about 60 minutes if desired, hydrolysis of the silane may be effected at the surface of the inorganic particles such as silica as described, for example, in Example 2 of U.S. Pat. No. 3,915,735, the disclosure thereof being incorporated herein in its entirety.

Silica particles treated with bi-functional silane coupling agents are also commercially available. For example, silica particles reacted with an amino silane are available as AEROSL™ S502, AEROSIL™ S506 and AEROSIL™ R504, from Degussa AG. AEROSIL™ 130, 150, 200 and 300 also available from Degussa AG or CAB-O-SIL™ H5, EH5, HS5, MS, M7, MS5, MS7, and M7D may be surface treated by following the silane/silica treatment procedure described above and used in the vinyl acetate layer of this invention. Both AEROSIL™ and CAB-O-SIL™ products are synthetic amorphous silica and are spherical in shape.

The polyester employed in the vinyl acetate layer is a vinyl acetate composition. The following preferred vinyl acetate compositions are available from National Starch: 25-1411 also known as RESYN™ 1411 (poly(vinyl alcohol-vinyl acetate) copolymer); 25-2028 also known as RESYN™ X-208 (self-crosslinking vinyl acetate copolymer); 25-6319 also known as RESYN™ 6319 (polyvinyl acetate homopolymer; 25-1090 also known as DUR-O-SET™ C-310 (polyvinyl acetate homopolymer); 25-1601 also known as RESYN™ 1601 (polyvinyl alcohol stabilized poly(vinyl alcohol-vinyl acetate) copolymer); 25-2015 also known as DUR-O-SET™ SB-321

(hydroxyethyl cellulose stabilized polyvinyl acetate homopolymer); 25-1015 also known as RESYN™ 1015 (polyvinyl acetate homopolymer); 25-1072 also known as RESYN™ 1072 (dextrin stabilized polyvinyl acetate homopolymer); 25-1027 also known as RESYN™ 1027 (polyvinyl alcohol stabilized polyvinyl acetate homopolymer); 25-1025 also known as RESYN™ 1025 (polyvinyl alcohol stabilized polyvinyl acetate homopolymer); 25-2035 also known as DUR-O-SET™ C-335 (polyvinyl acetate homopolymer); 25-1010 also known as DUR-O-SET™ C-325 (polyvinyl alcohol stabilized polyvinyl acetate homopolymer).

The vinyl acetate composition preferably includes a poly (vinyl alcohol-vinyl acetate) copolymer such as RESYN™ 1411. For RESYN™ 1411, it is believed that the vinyl alcohol monomer is present in an amount ranging from about 50% to about 75% by mole percent based on the poly(vinyl alcohol-vinyl acetate) copolymer, and the vinyl acetate is present in an amount ranging from about 50% to about 25% by mole percent based on the poly(vinyl alcohol-vinyl acetate) copolymer.

The vinyl acetate layer of this invention should contain at least about 1 percent by weight vinyl acetate composition based on the total weight of the vinyl acetate layer. Any suitable non-vinyl acetate composition film forming polymer may be employed in a blend with the vinyl acetate composition. The non-vinyl acetate composition film forming polymer must be miscible with the vinyl acetate composition at the proportion selected. Typical non-vinyl acetate composition film forming polymers that can be miscible with vinyl acetate composition, depending upon the specific vinyl acetate composition and proportional ratio selected, include polycarbonates, polyvinyl chlorides, polyvinylbutyrals, polyvinylpyrrolidones, polyurethanes, polymethyl methacrylates, and the like. Since the degree of miscibility varies with the specific non-vinyl acetate composition film forming polymer and specific vinyl acetate composition selected, some experimentation with the materials selected is desirable to determine whether the selected proportions are miscible.

Any suitable conventional coating technique may be utilized to apply the vinyl acetate layer of this invention to the supporting substrate. Typical coating techniques include solvent coating, extrusion coating, spray coating, lamination, dip coating, solution spin coating and the like. The wet deposited coating may be dried by any conventional drying technique such as oven drying, forced air drying, circulating air oven drying, radiant heat drying, and the like to give a satisfactory dry thickness of between about 0.05 micrometer and about 3 micrometers. A thickness range between about 0.07 micrometers and about 2 micrometers is preferred. Optimum results are achieved with a thickness between about 0.1 micrometer and about 1.5 micrometers.

The present vinyl acetate layer provides an adhesion ranging for example from about 5 to 40 g/cm, preferably from about 10 to about 30 g/cm. The adhesion values described herein are based on a tensile test performed on an Instron device.

When the vinyl acetate layer is a single charge blocking adhesive layer, it performs the dual functions of a blocking layer that prevents migration of positive charges from the underlying conductive surface of the substrate and an adhesive layer thereby eliminating the need for separately applied blocking and adhesive layers. This greatly simplifies the device structure, reduces fabrication steps, increases product yield and reduces costs.

When the vinyl acetate layer is an adhesive layer (i.e., there is a separate charge blocking layer), the vinyl acetate layer provides a desirable adhesive property.

Any conventional charge blocking layer may be employed when the vinyl acetate layer is an adhesive layer. A conventional blocking layer can include polymers, such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387, 4,286,033, and 4,291,110. A preferred conventional hole blocking layer comprises a reaction product of a hydrolyzed silane or a mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes can then be used as is well known in the art. For example, see U.S. Pat. No. 5,091,278 to Teuscher et al. A conventional blocking layer should be continuous and can have a thickness of up to 2 micrometers depending on the type of material used. However, a conventional blocking layer preferably has a thickness of less than about 0.5 micrometer because greater thicknesses may lead to undesirably high residual voltage. A blocking layer between about 0.005 micrometer and about 0.3 micrometer is satisfactory for most applications because charge neutralization after the exposure step is facilitated and good electrical performance is achieved. A thickness between about 0.03 micrometer and about 0.06 micrometer is preferred for blocking layers for optimum electrical behavior.

In fabricating an electrostatographic imaging member, a charge generating material (CGM) and a charge transport material (CTM) may be deposited onto the substrate surface either in a laminate type configuration where the CGM and CTM are in different layers or in a single layer configuration where the CGM and CTM are in the same layer along with a binder resin. Thus, the electrostatographic imaging member may have one imaging layer or two imaging layers. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable polymeric film forming binder material may be employed as the matrix of the charge generating layer. Typical polymeric film forming materials include those described, for example, in U.S. Pat. No. 3,121,006, the disclosure thereof being incorporated herein in its entirety. When the charge generating layer is applied to the vinyl acetate layer of this invention, the binder polymer of the charge generating layer should adhere well to the vinyl acetate layer, dissolve in a solvent which may also partially dissolve the upper surface of the vinyl acetate layer and is miscible with the vinyl acetate composition of the vinyl acetate layer to form a polymer blend zone.

It is not necessary that the charge generating layer should dissolve the upper surface of the vinyl acetate layer. For example, in fabricating a photoreceptor by dip coating, we can choose the solvent system to deliberately avoid dissolution of a prior layer. Adhesion does not necessarily require dissolution. Intuitively it appears that the dissolution of the upper surface of the vinyl acetate layer may give a better bond with the charge generating layer and facilitate injection of charge.

Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; polycarbonate resin, vanadyl phthalocyanine and methylene chloride; polystyrene, vanadyl phthalocyanine and butyl acetate. The solvent for the charge generating layer should dissolve the polymer binder utilized in the charge generating layer and be capable of dispersing the photogenerating pigment particles present in the charge generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable technique may be utilized to mix and thereafter apply the charge generating layer (also referred herein as photogenerating layer) coating mixture to the previously dried vinyl acetate layer. Drying of the deposited coating may be effected by any suitable conventional technique.

The charge transport layer may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack. The charge transport layer is normally transparent in a wavelength region in which the electrophotographic imaging member is to be used when exposure is effected therethrough to ensure that most of the incident radiation is utilized by the underlying charge generating layer. The charge transport layer should exhibit negligible charge generation, and discharge if any, when exposed to a wavelength of light useful in xerography, e.g., 4000 to 9000 Angstroms. When used with a transparent substrate, imagewise exposure or erase may be accomplished through the substrate with all light passing through the substrate. In this case, the charge transport material need not transmit light in the wavelength region of use if the charge generating layer is sandwiched between the substrate and the charge transport layer. The charge transport layer in conjunction with the charge generating layer is an insulator to the extent that an electrostatic charge placed on the charge transport layer is not conducted in the absence of illumination. The charge transport layer should trap minimal charges either holes or electrons as the case may be passing through it. Charge transport layer materials are well known in the art.

The charge transport layer may comprise activating compounds or charge transport molecules dispersed in normally, electrically inactive film forming polymeric materials for making these materials electrically active. These charge transport molecules may be added to polymeric materials which are incapable of supporting the injection of photogenerated holes and incapable of allowing the transport of these holes. An especially preferred transport layer employed in multi-layer photoconductors comprises from about 25 percent to about 75 percent by weight of at least one charge transporting aromatic amine, and about 75 percent to about 25 percent by weight of a polymeric film forming resin in which the aromatic amine is soluble. Examples of typical charge transporting aromatic amines include triphenylmethane, bis(4-diethylamine-2-methylphenyl)phenylmethane; 4'-4"-bis(diethylamino)-2', 2"-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis(3"-methylphenyl)-(1,1'-biphenyl)-4,4'-diamine; and the like, dispersed in an inactive resin binder.

Any suitable inactive resin binder soluble in methylene chloride or other suitable solvents may be employed for the charge transport layer. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The thickness of the charge transport layer may range from about 10 micrometers to about 50 micrometers, and preferably from about 20 micrometers to about 35 micrometers. Optimum thicknesses may range from about 23 micrometers to about 31 micrometers.

An optional conventional ground strip may be utilized along one edge of the electrophotographic imaging member. The ground strip may comprise a film forming polymer binder and electrically conductive particles. The ground strip may comprise materials including those enumerated in U.S. Pat. No. 4,664,995. The ground strip layer may have a thickness from about 7 micrometers to about 42 micrometers, and preferably from about 14 micrometers to about 23 micrometers.

An optional conventional anti-curl layer may also be employed. The anti-curl layer may comprise organic polymers or inorganic polymers that are electrically insulating or slightly semi-conductive. The anti-curl layer provides flatness and/or abrasion resistance. The anti-curl layer is formed at the back side of the substrate, opposite to the imaging layers. The thickness of the anti-curl layer is from about 3 micrometers to about 35 micrometers, and preferably about 14 micrometers.

An optional conventional overcoating layer may also be used. The optional overcoating layer may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers. An optimum range of thickness is from about 3 micrometers to about 5 micrometers.

Figure 2:
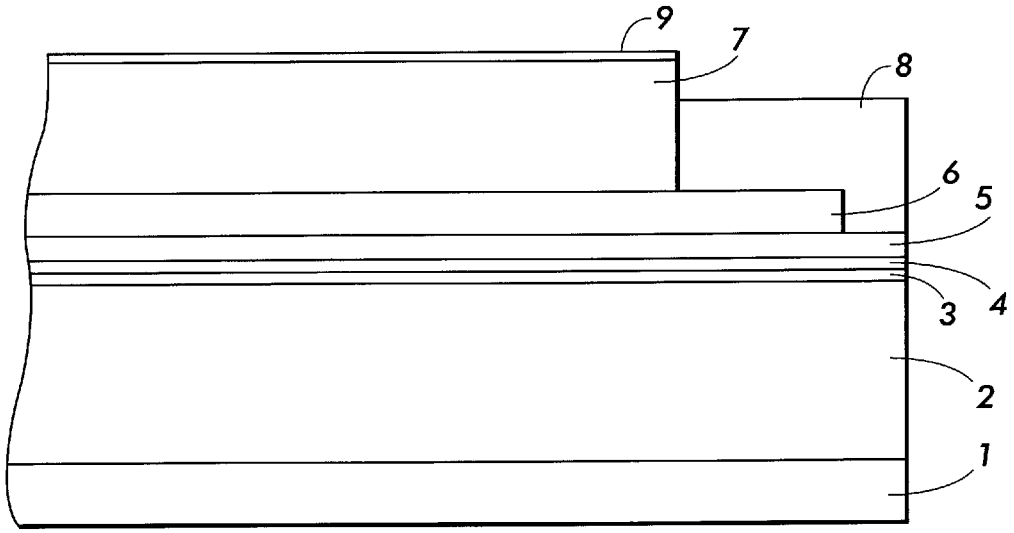
FIG. 2 shows a simplified, elevational view of another embodiment of the present invention.

The structure of a typical electrophotographic imaging member of one embodiment of this invention is shown in FIG. 1 which discloses an anti-curl back coating 1, a supporting substrate 2, an electrically conductive ground plane 3, a charge blocking adhesive layer 10 (layer 10 is the vinyl acetate layer), a charge generating layer 6, a charge transport layer 7, a ground strip 8 and an optional overcoating layer 9. FIG. 2 discloses another embodiment where there is provided an anti-curl back coating 1, a supporting substrate 2, an electrically conductive ground plane 3, a charge blocking layer 4, an adhesive layer 5 (layer 5 is the vinyl acetate layer), a charge generating layer 6, a charge transport layer 7, a ground strip 8 and an optional overcoating layer 9.

In embodiments, the vinyl acetate layer of this invention greatly simplifies the structure of prior art multi-layered electrophotographic imaging members by replacing separate charge blocking layer and adhesive layer combinations. In the embodiments of the present invention, the coating of a charge blocking layer followed by application of an adhesive layer was eliminated by a single layer which simultaneously provides adhesion linkage and charge blocking functions. The present invention produced numerous benefits including elimination of all the disadvantages associated with the separate charge blocking layer, simplification of the electrophotographic imaging member structure, and increased production throughput and yield. The stronger adhesion bond strength provided by the single vinyl acetate layer of this invention reduces seam cracking and layer delamination in welded multi-layered electrophotographic imaging members. The vinyl acetate layer of this invention can provide both charge blocking and adhesive functions for a seamless imaging member employing a conductive seamless polymeric support substrate. The present invention can improve the cyclic life of a photoreceptor belt since the adhesion of the charge generating layer is higher. Thus, the stripping and tearing of the photoreceptor belt in a machine after many cycles will be reduced. Moreover, substitution of the vinyl acetate layer of this invention for both the charge blocking layer and adhesive layer of prior art multi-layered electrophotographic imaging devices did not adversely affect the photoelectrical integrity of the imaging devices. In addition, the vinyl acetate composition is environmentally friendly since it is preferably an emulsion polymer in water. The present layer containing the vinyl acetate composition is suitable for dip coating.

The invention will now be described in detail with respect to specific preferred embodiments thereof, it being noted that these examples are intended to be illustrative only and are not intended to limit the scope of the present invention. Parts and percentages are by weight unless otherwise indicated.

COMPARATIVE EXAMPLE

A flexible electrophotographic imaging member was prepared by providing a titanium coated polyester substrate (Melinex 442, available from ICI Americas, Inc.) having a thickness of 3 mils (76.2 micrometers) and applying thereto, using a ½ mil gap Bird applicator, a solution containing 10 gms 3-aminopropyltriethoxysilane, 10.1 gms distilled water, 3 gms acetic acid, 684.8 gms of 200 proof denatured alcohol and 200 gms heptane. This layer was then allowed to dry for 5 minutes at 135 degrees C in a forced air oven. The resulting charge blocking layer had an average dry thickness of 0.05 micrometer measured with an ellipsometer. However, the ellipsometry profile showed an extremely non-uniform silane thickness due to surface irregularities and the formation of islands of siloxane aggregates.

An adhesive interface layer was then prepared by applying with a ½ mil gap Bird applicator to the blocking layer a wet coating containing 0.5 to 1.1 percent by weight based on the total weight of the solution of polyester adhesive (DuPont 49,000, available for E. I. du Pont de Nemours & Co.) in a 70:30 volume ratio mixture of tetrahydrofuran/cyclohexanone. The adhesive interface layer was allowed to dry for 5 minutes at 135 degrees C in the forced air oven. The resulting adhesive interface layer had a dry thickness of 0.12 micrometer.

The adhesive interface layer was thereafter coated with a photogenerating layer (also referred herein as a charge generating layer) containing 7.5 percent by volume trigonal selenium, 25 percent by volume N,N'-diphenyl-N,N'-bis(3-methylphenyl)-(1,1'-biphenyl)-4,4'-diamine, and 67.5 percent by volume polyvinylcarbazole. This photogenerating layer was prepared by introducing 8 gms polyvinyl carbazole and 140 mls of a 1:1 volume ratio of a mixture of tetrahydrofuran and toluene into a 20 oz. amber bottle. To this solution was added 8 gms of trigonal selenium and 1,000 gms of ⅛ inch (3.2 millimeter) diameter stainless steel shot. This mixture was then placed on a ball mill for 72 to 96 hours. Subsequently, 50 gms of the resulting slurry were added to a solution of 3.6 gms of polyvinyl carbazole and 2.0 gms of N,N'-diphenyl-N,N'-bis(3-methylphenyl)-(1,1'-biphenyl)4,4'-diamine dissolved in 75 ml of 1:1 volume ratio of tetrahydrofuran/toluene. This slurry was then placed on a shaker for 10 minutes. The resulting slurry was thereafter applied to the adhesive interface layer by using a ½ mil gap Bird applicator to form a coating layer having a wet thickness of 0.5 mil (12.7 micrometers). This photo-generating layer was dried at 135 degrees C for 5 minutes in the forced air oven to form a dry thickness photogenerating layer having a thickness of 2.0 micrometers.

This coated imaging member web was overcoated with a charge transport layer and a ground strip layer using a 3 mil gap Bird applicator. The charge transport layer was prepared by introducing into an amber glass bottle a weight ratio of 1:1 N,N'-diphenyl-N,N'-bis(3-methylphenyl)-(1,1'-biphenyl)4,4'-diamine and Makrolon 5705, a polycarbonate resin having a molecular weight of from about 50,000 to 100,000 commercially available from Farbensabricken Bayer A.G. The resulting mixture was dissolved to give a 15 percent by weight solids in 85 percent by weight methylene chloride. This solution was applied onto the photogenerator layer to form a coating which upon drying had a thickness of 24 micrometers. The layer is dried in an oven at 135 degrees C for 5 minutes.

The approximately 3 mm wide strip left uncoated by the photogenerator layer was coated with a ground strip. The resulting imaging member web containing all of the above layers was annealed at 135 degrees C in the forced air oven for 5 minutes. This ground strip layer had a dried thickness of about 14 micrometers. This ground strip is electrically grounded, by conventional means such as a carbon brush contact in an electrical scanner.

An anti-curl coating (also referred herein as "ACBC") may be applied if a belt is to be fabricated to keep the surface of the photoreceptor from curling up. The ACBC provides only mechanical support and is not functional in electrical performance of the sample. This anti-curl coating may be prepared by combining 8.82 gms of polycarbonate resin (Makrolon 5705, available from Bayer AG), 0.09 gm of polyester resin (Vitel PE-100, available from Goodyear Tire and Rubber Company) and 90.1 gms of methylene chloride in a glass container to form a coating solution containing 8.9 percent solids. The container should be covered tightly and placed on a roll mill for about 24 hours until the polycarbonate and polyester are dissolved in the methylene chloride to form the anti-curl coating solution. The anti-curl coating solution may then be applied to the rear surface (side opposite the photogenerator layer and charge transport layer) of the imaging member with a 3 mil gap Bird applicator and dried at 135 degrees C for about 5 minutes in the forced air oven to produce a dried film thickness of about 13.5 micrometers. The resulting electrophotographic imaging member had a structure similar to that schematically shown in FIG. 2 and was used as an imaging member control.

This sample was tested in an electrical scanner for electrical performance. It showed high dark decay and high depletion charge.

Next the mechanical testing was done on an Instron. The reverse peel test (a measure of the adhesive property) showed the tensile strength to be 4.8 g/cm.

EXAMPLE 1

A flexible electrophotographic imaging member was prepared by following the procedures and using the same materials as described in the Comparative Example, except that the 49,000 adhesive layer was replaced by the poly (vinyl alcohol-vinyl acetate) copolymer (25-1411 from National Starch). The solution for the poly(vinyl alcohol-vinyl acetate) copolymer was prepared in the following manner.

About 3.92 grams of the 25-1411 concentrate as received with 51% solids, was diluted to 1% solids by adding 196.08 grams of a solution of 50% ethanol and 50% deionized water. The mixture was mechanically stirred until a clear solution is obtained. The ratio of water to alcohol may vary from 5% water to 95% water. Methanol, propanol, isopropanol and the butanols could also be used instead of ethanol.

The electrical test showed comparable dark decay to that of the Comparative Example; however, there was no depletion charge seen. The reverse peel strength showed almost an order of magnitude improvement over the Comparative Example.

EXAMPLE 2

A third flexible electrophotographic imaging member was prepared by following the procedures and using the same materials as described in the Comparative Example, except that the separate charge blocking layer and the 49,000 adhesive layer were replaced by a single charge blocking adhesive layer coated from a mixture of the poly(vinyl alcohol-vinyl acetate) copolymer (25-1411 from National Starch) with 3-aminopropyltriethoxysilane (also referred herein as "3-APS"). No separate blocking layer was coated below the adhesive layer. The solution for the vinyl acetate layer was prepared in the following manner. About 1.96 grams of 25-1411 concentrate as received with 51% solids was diluted to 1% solids by adding 98.04 grams of a solution of 50% ethanol and 50% deionized water. The mixture was mechanically stirred until a clear solution was obtained. To this was added a solution of 1.0 gram of 3-APS in 99.0 grams of deionized water and the resulting solution was stirred for 2 hours. The solution for the vinyl acetate layer was now ready to coat using a 0.5 mil wet gap Bird applicator.

The sample was tested in an electrical scanner. It showed much improved dark decay compared to the samples of the Comparative Example and Example 1 and no depletion charge just as in Example 1. The adhesion as shown by the reverse peel test in an Instron gave an order of magnitude improvement over the sample of the Comparative Example.

An investigation of the charge deficient spots which are localized spots of less than 100 micrometers and exhibit very high local dark decay was carried on in a Stylus Scanner. These spots gave rise to dark spots in prints in a machine using Discharge Area Development or as micro white spots in prints in a machine using Charged Area Development. The sample of Example 2 showed comparable results in the number of charge deficient spots per unit area compared with the Comparative Example and Example 1.

Other modifications of the present invention may occur to those skilled in the art based upon a reading of the present disclosure and these modifications are intended to be included within the scope of the present invention.

We claim:

1. An electrostatographic imaging member comprising:

(a) a substrate;

(b) a charge blocking layer;

(c) an adhesive layer including a vinyl acetate composition; and (d) an imaging layer.

2. The member of claim 1, wherein the adhesive layer consists of the vinyl acetate composition.

3. The member of claim 1, wherein the adhesive layer further includes an organosilane.

4. The member of claim 1, wherein the adhesive layer further includes a plurality of inorganic oxide particles coated with an organosilane.

5. The member of claim 1, wherein the vinyl acetate composition includes a poly(vinyl alcohol-vinyl acetate) copolymer.

6. The member of claim 5, wherein vinyl alcohol monomer is present in an amount ranging from about 50% to about 75% by mole percent based on the copolymer, and the vinyl acetate is present in an amount ranging from about 50% to about 25% by mole percent based on the copolymer.

7. The member of claim 1, wherein the vinyl acetate composition includes a polyvinyl acetate hompolymer.

8. The member of claim 1, wherein the vinyl acetate composition includes polyvinyl alcohol and a poly(vinyl alcohol-vinyl acetate) copolymer.

9. The member of claim 1, wherein the vinyl acetate composition includes hydroxyethyl cellulose and polyvinyl acetate homopolymer.

10. The member of claim 1, wherein the vinyl acetate composition includes dextrin and polyvinyl acetate homopolymer.

11. The member of claim 1, wherein the vinyl acetate composition includes polyvinyl alcohol and a polyvinyl acetate homopolymer.

12. The member of claim 1, wherein the imaging layer is a charge generating layer and further comprising (e) a charge transport layer.

13. An electrostatographic imaging member comprising:

(a) a substrate;

(b) a charge blocking adhesive layer including a vinyl acetate composition; and (c) an imaging layer, wherein there is absent a charge blocking layer disposed between the substrate and the charge blocking adhesive layer, and there is absent an adhesive layer disposed between the charge blocking adhesive layer and the imaging layer.

14. The member of claim 13, wherein the charge blocking adhesive layer consists of the vinyl acetate composition.

15. The member of claim 13, wherein the charge blocking adhesive layer further includes an organosilane.

16. The member of claim 13, wherein the charge blocking adhesive layer further includes a plurality of inorganic oxide particles coated with an organosilane.

17. The member of claim 13, wherein the vinyl acetate composition includes a poly(vinyl alcohol-vinyl acetate) copolymer.

18. The member of claim 17, wherein vinyl alcohol monomer is present in an amount ranging from about 50% to about 75% by mole percent based on the copolymer, and the vinyl acetate is present in an amount ranging from about 50% to about 25% by mole percent based on the copolymer.

19. The member of claim 13, wherein the vinyl acetate composition includes a polyvinyl acetate hompolymer.

20. The member of claim 13, wherein the vinyl acetate composition includes polyvinyl alcohol and a poly(vinyl alcohol-vinyl acetate) copolymer.

21. The member of claim 13, wherein the vinyl acetate composition includes hydroxyethyl cellulose and polyvinyl acetate homopolymer.

22. The member of claim 13, wherein the vinyl acetate composition includes dextrin and polyvinyl acetate homopolymer.

23. The member of claim 13, wherein the vinyl acetate composition includes polyvinyl alcohol and a polyvinyl acetate homopolymer.

24. The member of claim 13, wherein the imaging layer is a charge generating layer and further comprising (d) a charge transport layer.

25. The member of claim 13, wherein the charge blocking adhesive layer further includes a charge blocking material.

* * * * *